US008810911B2

(12) United States Patent
Hwang

(10) Patent No.: US 8,810,911 B2
(45) Date of Patent: Aug. 19, 2014

(54) HIGH COLOR SATURATION LIGHT CONTROLLER AND LIGHTING DEVICE THEREFOR

(76) Inventor: Yu-Chen Hwang, Xinwu Township (TW)

( * ) Notice: Subject to any disclaimer, the term of this patent is extended or adjusted under 35 U.S.C. 154(b) by 0 days.

(21) Appl. No.: 13/408,981

(22) Filed: Feb. 29, 2012

(65) Prior Publication Data

US 2013/0107342 A1 May 2, 2013

(30) Foreign Application Priority Data

Oct. 28, 2011 (TW) ..... 100220397 U

(51) Int. Cl.
*G09F 13/18* (2006.01)
*G09F 13/22* (2006.01)
*G09F 13/08* (2006.01)

(52) U.S. Cl.
CPC ..... *G09F 13/18* (2013.01); *G09F 13/22* (2013.01); *G09F 13/08* (2013.01); *G09F 2013/222* (2013.01)
USPC ..... 359/599; 359/707; 40/442

(58) Field of Classification Search
CPC .... G09F 13/18; G09F 13/22; G09F 2013/222
USPC ..... 359/454, 455, 618, 619, 621–626, 628, 359/237–324, 599, 707; 40/454, 442, 444; 362/355, 253
See application file for complete search history.

(56) References Cited

U.S. PATENT DOCUMENTS

| | | | | |
|---|---|---|---|---|
| 6,867,833 | B2 * | 3/2005 | Chang et al. | 349/114 |
| 2006/0110580 | A1 * | 5/2006 | Aylward et al. | 428/172 |
| 2008/0310155 | A1 | 12/2008 | Huang et al. | |
| 2009/0097114 | A1 * | 4/2009 | Mimura et al. | 359/463 |

* cited by examiner

*Primary Examiner* — Darryl J Collins
*Assistant Examiner* — Gary O'Neill
(74) *Attorney, Agent, or Firm* — George P. White

(57) ABSTRACT

A highly color saturated light modulator includes a transparent substrate, printed image layer and a protection layer on the printed surface. The degree of color saturation of images on the modulator is greater than 40% and overall transmission between 15% and 95%. Lighting devices with the light modulator can be designed to meet desired light emitting intensity and direction by integrating micro-structures to the transparent substrate.

16 Claims, 3 Drawing Sheets

HIGH COLOR SATURATION LIGHT CONTROLLER AND LIGHTING DEVICE THEREFOR

RELATED APPLICATIONS

This application claims priority of Taiwan Patent Application No. 100220397, filed Oct. 28, 2011, the entire disclosure of which is incorporated herein by reference.

BACKGROUND

Traditional incandescent lamps have issues of high power consumption and short lifetime. The invention of light emitting diode (LED) solved the power consumption and lifetime issues. It is also expected to be a mainstream light source in the future. LED lighting is recently commercialized and aggressively taking market share.

An LED is a directional light source with high brightness. Therefore, diffusers are required to distribute light into a desired uniform light output and to provide sufficient overall brightness in a space without hot spots. A diffuser also prevents the discomfort of staring directly at the lighting device. Diffusers are frequently made of polymer resin with particles of various refraction indices to create the diffusing effect through light scattering. In order to simultaneously achieve the high total brightness and uniform lighting performance, diffusers with surface optical patterns are usually used. In addition, integration of a surface patterned diffuser with a light guide can make for the very flexible design of lighting devices.

In addition to a uniformity requirement of LED-based lights, there is also a need for artistic presentation.

BRIEF SUMMARY

These teachings include the integration of a digitally printed transparent substrate with surface micro-structures to achieve high brightness and high uniformity artistic lighting. A modulator can be used in LED lighting designs to provide a decorative lighting effect. These teachings provide designs of lighting devices to meet both the needs of optical performance and aesthetics. High performance digital printing technology allows artwork to be duplicated sophisticatedly in high color saturation. The colorant particles in the images perform like a color filter and a diffuser. Colorants help in randomizing directional light from an LED and can exhibit high color saturation. Digital printing on a light guide plate, optionally with built in micro-structures on its surface, allows the creation of a high brightness and high color saturation and artistic light modulator.

BRIEF DESCRIPTION OF THE DRAWINGS

For a further understanding of the present invention, reference will be made to the following detailed description of embodiments of the invention that are to be read in connection with the accompanying drawing, wherein.

DESCRIPTION OF KEY ELEMENTS

Figure 1:
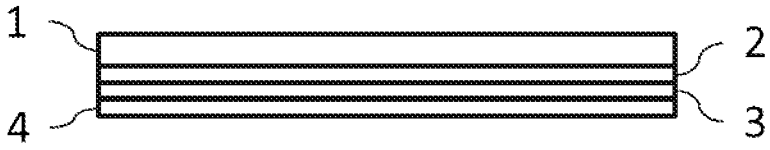
FIG. 1 is a structural diagram of highly color saturated light modulator.

1. Transparent substrate
2. Surface modifier layer
3. Printed images
4. Protection layer
5. Prism structure
6. Half sphere structure
7. LED light source
8. Light guide plate
9. Carrier

DETAILED DESCRIPTION

LEDs are point light sources which result in a light gradient and non-uniformity between LEDs in an array. Therefore, a diffuser is needed to eliminate hot spots from LED locations and to distribute the light to cover the desired complete space. Diffusers are traditionally made of polymer with inorganic particles in different refraction indexes. Refraction, scattering and reflection occur when light passes through a diffuser. Film with a rough surface is also used to diffuse light but is more expensive to make. Therefore, polymer with particle additives is still the most common type of LED diffuser.

The purpose of a diffuser plate is to randomize directional light from point or line light sources by passing the light through a composite material, creating a desired homogenous plane of light. The standard illuminance test is performed at a distance beyond 2.5 meters. It means that a 30-watt lighting fixture with diffuser above critical transmission level requires 1.5% additional light source power to compensate the loss of 1% in diffuser transmission. In other words, it takes 4.5 watts to compensate the loss of 3% transmission at the diffuser. The extra cost of energy can be more than the added cost from a high transmission diffuser. The importance of diffuser characteristics is being realized and becoming the focal point for improvement. While LEDs are vigorously taking market share in the lighting business, diffusers incorporation into LED design becomes a necessity to provide comfort of our living environment.

Diffusers made from particle additives have poor light diffusing property and they are usually hazy, translucent, and of low transmission. The resulting LED devices are low brightness and lose much of the value of energy saving. In embodiments of the present teaching, digital printing is used to produce highly color saturated images on a transparent base plate. Highly saturated colorants in the ink generate the light scattering effect to diffuse light. Optional Integration of micro-structures on the base plate can enable the base plate to manage the scattered light and enhance the emitting of light uniformly. The resulting light modulator shows homogenous surface light with highly color saturated decorative printings.

Most commonly used micro-structures are prism, micro lenses and their alternations. Prism structures can manage the randomly scattered light to the emitting direction and enhance the brightness. Micro lenses have very efficient diffusing effect with some light enhancement effect. Proper design of micro-structures enables good light diffusing performance and high transmission.

Screen-printing is low in resolution and color saturation and result in poor image quality. On the other hand, inkjet printing can be operated in high speed with high image resolution and color saturation. Digital inkjet printing is especially applicable to this application since it requires no printing plates and allows unlimited content alternations and direct printout. This flexibility enables small quantity production and savings in the materials and man-hours from eliminating the plate making process. In addition, inkjet printing is a non-contact process; therefore, it can be used to print on rough surfaces. The direct or acidic dyes from the aqueous ink used in inject printing are of low flammability, are fire proof and environmentally friendly, but can be difficult to dry. Therefore, special treatment of the transparent substrate may be desirable to improve wetting properties. It is important to match the ink property and substrate surface property in order to provide high-resolution images and good adhesion of ink to the base plate.

As illustrated in FIG. 1, a transparent substrate (1) is used to receive high-resolution digital printing. A surface modifier layer (2) is needed with glass substrate, but not for substrates with good adhesion to the ink at the printed image layer (3). An ink protection layer (4) covers the printed images layer (3) for long-term durability by preventing damages from scratches and moisture uptake of aqueous ink. This structure provides the highly color saturated light modulator, referred as printed light modulator here after.

In order to achieve high-quality artistic images, the color saturation preferably is higher than 40% based on the CIE color space. Under strong edge or direct LED light source, low color saturation can result in poor contrast ratio of images. Degrees of color saturation higher than 80% and image coverage more than 80% can result in poor light transmission. At less than 20% transmission the lighting efficiency is decreased significantly. Therefore, the preferable light modulator comes from controlling image color saturation to greater than 40% with an overall light transmission of between 20% and 95%. Incorporation of micro-structures into the printed modulator can achieve high color saturation, high contrast ratio, and high transmission at the same time.

Color saturation of images can be controlled by the selection of different colorants and printing thickness. Thicker prints will result in high color saturation. Overall transmission is determined by the ratio of illuminance directly detected from lighting device with the modulator over the light measured without the printed light modulator.

Figure 2:
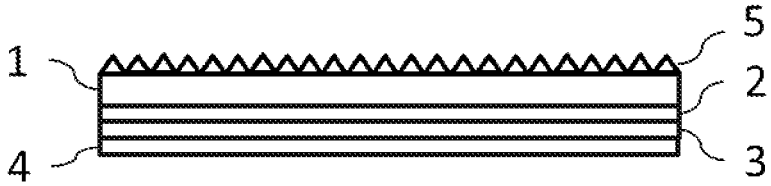
FIG. 2 is a structural diagram of highly color saturated light modulator with prism patterns on the surface.

As illustrated in FIG. 2, prism structures (5) can be introduced to non-printed surface of the light modulator. This can be achieved by building prism structures (5) on the transparent substrate before printing or by attaching additional prism film before or after printing on the other side. The prism structures (5) help manage the light to emitting direction and enhance overall transmission. The micro-structured transparent substrate can be selected from EML products of Entire Company.

Portions of light energy turn into heat during the refraction and reflection processes. That results in temperature elevation and decreases the lifetime of lighting device. Prism structures (5) help to rearrange light to the needed direction and eliminates excessive reflection and enhances the overall transmission. Most commercially available prism films are made from UV curing of resin coated plastic film under micro-structured roller. After removal of the roller, the prism structures are formed on the plastic film for light management applications. Light goes through the diffuser and provides a uniform plane of light which is managed by prism structures to change light direction and increase emitting intensity.

Figure 3:
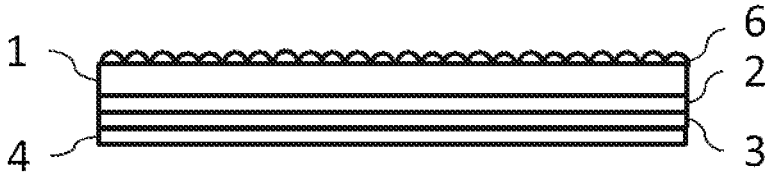
FIG. 3 is a structural diagram of highly color saturated light modulator with half sphere lens patterns on the surface.

As illustrated in FIG. 3, half-sphere structures (6) can be introduced into the light modulator structure to further diffuse and manage light directions. Again, the half-sphere structure (6) can be built on the transparent substrate or externally attached with a micro lens film, followed by printing.

Figure 4:
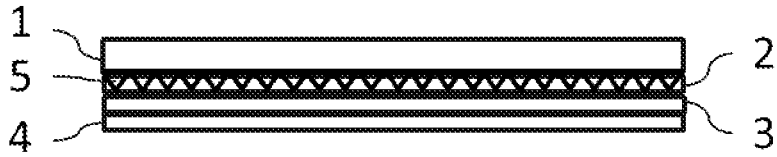
FIG. 4 is another structural diagram of highly color saturated light modulator with prism patterns inside.

Surface modifier layer (2), highly color saturated printed image layer (3), and ink protection layer (4) can also be on the same side of micro-structures, as illustrated in FIG. 4. The resulting visual effect is slightly different from the structures illustrated in FIG. 2 and FIG. 3. The preferred choice in a specific application comes from the image content and aesthetic preference.

Lighting systems based on the present teachings can be designed with a light guide plate (LGP) and LED light source. The purpose of a light guide is to guide light from the LED light source to different locations on the LGP according to total reflection. The printed patterns on the LGP disrupt total reflection and direct light to the surface of the LGP. The density of surface patterns on the LGP determines the light distribution. The higher the refraction index of an LGP the better its light guiding property. Portions of light that cannot be directed to the surface of the LGP will be reflected to the surface by a reflector. An LGP is often made of Poly (methyl methacrylate) (PMMA), other materials like Cyclo-olefin polymer (COP), and polycarbonate (PC) are also used.

Figure 5:
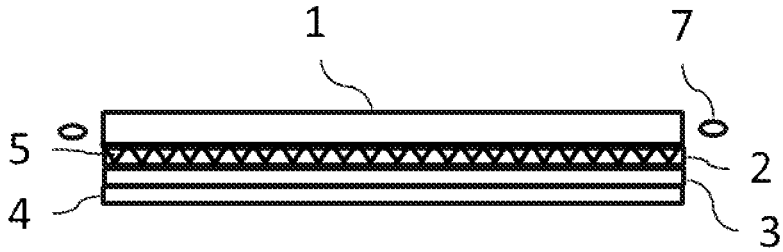
FIG. 5 is a structural diagram of lighting device using highly color saturated light modulator and edge type LED.

Transparent substrates (1) in accordance with these teachings are selected from glass or transparent plastics. Therefore, an LGP can be used as a printing substrate and serve as a light guide at the same time. As illustrated in FIG. 5, edge LED light source (7) is guided through transparent substrate (1) of the printed light modulator and emits light from the non-printed surface. Due to eliminating the use of an LGP, total thickness is reduced to provide a slim artistic lighting device. It is optional to have a reflector behind the protection layer (4) of the printed light modulator in order to increase the brightness and contrast of the printed image.

Figure 6:
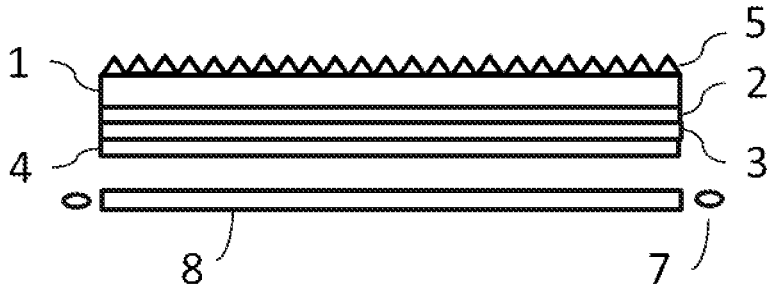
FIG. 6 is a structural diagram of lighting device using highly color saturated light modulator, light guide plate and edge type LED.
Figure 7:
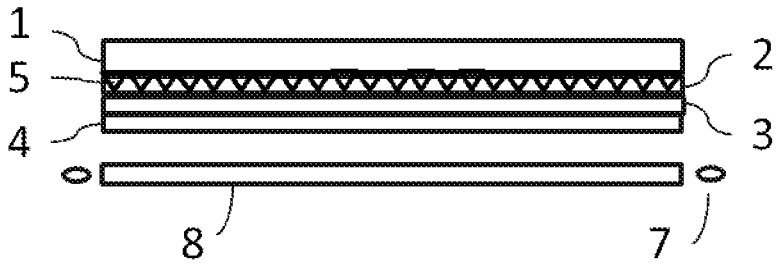
FIG. 7 is another structural diagram of lighting device using highly color saturated light modulator, light guide plate and edge type LED.

As illustrated in FIG. 6 and FIG. 7, an artistic lighting system can include a printed light modulator, and LED light sources (7) located at the edges of a light guide plate (8). A surface patterned light guide plate can be used as a micro structured transparent substrate (1). On the other hand, it can also be produced by glass or a plastic plate and externally adhered with a brightness enhancement film (BEF) that has a prism structure (5) on the surface. Even FIG. 6 and FIG. 7 require extra LGP compared to FIG. 5. These structures are more flexible for fine-tuning of optical performance. The only difference of FIG. 6 from FIG. 7 is printing on non-patterned surface instead of patterned surface. The light guide plate (8) in this design can be selected from a regular light guide plate, a light guide with brightness enhancement film, or a micro structured light guide plate. It is optional to have a reflector behind the light guide plate (8) of printed light modulator to increase brightness and contrast of printed image.

Figure 8:
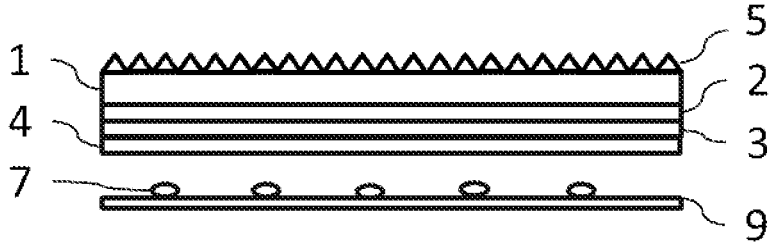
FIG. 8 is a structural diagram of lighting device using highly color saturated light modulator and direct type LED.

A direct type light source is formed by LEDs fixed on a carrier (9). As illustrated in FIG. 8, a lighting device includes printed light modulator, direct type LED light source or a plain organic light emitting diode (OLED). The carrier can be a metalized film used as an electrode for LED or OLED wiring. Metalized film is usually manufactured by sputtering Indium Tin Oxide (ITO) on polyethylene terephthalate (PET) film.

ITO metalized film can also be used as printing substrate (1) to provide a flexible lighting system. Printing is performed on the non-metalized side.

Although a prism structure is used in FIG. 4 and FIG. 8 to illustrate the structures of light modulator, the surface patterns for light management can also be micro lens, pyramid lenticular or other structure. depending on the desired optical performance.

EXAMPLES

Example embodiments of the present invention are described below by way of two examples. However, the present invention should be in no way restricted by the examples provided.

Example #1

As illustrated in FIG. 6, soda lime glass as substrate (1), 120 cm by 80 cm, was coated with surface modifier layer (2) to improve the adsorption speed and adhesion of ink to glass. Followed by digital inkjet printing with EPSON industrial printer, high resolution image layer (3) was covered by a transparent protection layer (4) which is a hard resin coating based on acrylic or epoxy resin. The resulting printed light modulator has 50% coverage of image area with color saturation of 55%.

A 3M Vikuiti film with prism pattern (5) was adhered to non-printed side of glass to form highly color saturated light modulator, which was made into artistic lighting device by integrating Entire EPG micro structured light guide plate (8) and twenty 36 watts of LEDs (7) from Opto Tech Corporation.

Lighting devices made from the above method show a homogenous brightness and high color saturation image with overall transmission of about 25%.

Example #2

As illustrated in FIG. 5, a micro structured EML light guide plate made by Entire Company was used as substrate (1). Digital printing was performed at the micro-structured side of the LGP by the method described in Example #1. No external LGP was added. The resulting thin printed light modulator was attached with twenty 36 watts of LEDs from Opto Tech Corporation. The resulting artistic thin lighting device shows high uniformity in brightness and color saturation with overall transmission of 87%.

Brightness uniformity for both examples are very good, but Example #2 provides better overall transmission than that of Example #1.

Moreover, as those of skill in this art will appreciate, many modifications, substitutions and variations can be made in and to a high color saturation lighting modulator of this invention without departing from its spirit and scope. In light of this, the scope of the present invention should not be limited to that of the particular embodiments illustrated and described herein, as they are only exemplary in nature, but instead, should fully commensurate with that of the claims appended hereafter and their equivalents.

What is claimed is:

1. A printed surface patterned light diffuser, comprising:
a transparent substrate,
a printed image layer on the substrate, and
a protection layer on the printed surface,
wherein the printed image layer of the printed surface patterned light diffuser substantially consists of an inkjet-printed image and wherein the printed image layer has greater than about 40% color saturation and overall light transmission is between about 15% and about 95%;
further, the transparent substrate comprises an optical microstructure on at least one surface where, at least partially, the microstructures manage the direction of transmitted light in order to diffuse the intensity of transmitted light.

2. The light diffuser of claim 1, wherein the transparent substrate is comprised of a plastic material.

3. The light diffuser of claim 1, wherein the transparent substrate is comprised of a glass material.

4. The light diffuser of claim 1, wherein the transparent substrate is comprised of a metalized plastic film.

5. The light diffuser of claim 1, wherein the transparent substrate has a surface modifier layer located between the substrate and the printed image layer, where the surface modifier is so constituted as to engender improved adhesion of the image layer to the substrate.

6. The light diffuser of claim 1, wherein the printed image layer is located on the same side of the substrate as the microstructure.

7. The light diffuser of claim 1, wherein the printed image layer is located on the opposite side of the substrate of the optical microstructure.

8. The light diffuser of claim 1, wherein at least a portion of the microstructures comprise the shape of a prism.

9. The light diffuser of claim 1, wherein at least a portion of the microstructures comprise the shape of a half-sphere lens.

10. The light diffuser of claim 1, wherein at least a portion of the microstructures comprise the shape of a half-sphere lens and at least a portion of the microstructures comprise a prism shape.

11. The light diffuser of claim 1, wherein at least a portion of the microstructures are formed directly on the transparent substrate.

12. The light diffuser of claim 1, wherein at least a portion of the microstructures comprise a distinct attached film having the microstructures.

13. A lighting system, comprising a printed surface patterned light diffuser comprising:
a transparent substrate,
a printed image layer on the substrate, and
a protection layer on the printed surface,
where the printed image layer of the printed surface patterned light diffuser substantially consists of an inkjet-printed image and wherein the printed image layer has greater than about 40% color saturation and overall light transmission is between about 15% and about 95%, in combination with light emitting diodes;
further, the transparent substrate comprises an optical microstructure on at least one surface, the microstructure such as to contribute to diffusing transmitted light.

14. The lighting system of claim 13 where the light emitting diodes are operatively coupled to the light diffuser.

15. The lighting system of claim 14, further comprising a light guide plate operatively coupled to the light emitting diodes and the light diffuser; optionally, the light guide includes microstructures on one surface and a reflector on an opposing surface.

16. The lighting system of claim 13, wherein the light emitting diodes comprise a plane light source or, optionally, comprise an array of point light source fixed on a carrier.

* * * * *